US006038757A

United States Patent [19]

Müller et al.

[11] Patent Number: 6,038,757

[45] Date of Patent: Mar. 21, 2000

[54] METHOD OF OPERATING A ROLL STAND ARRANGEMENT

[75] Inventors: Hubert Müller, Grevenbroich; Ulrich Svejkovsky, Wuppertal, both of Germany

[73] Assignee: SMS Schloemann-Siemag Aktiengesellschaft, Düsseldorf, Germany

[21] Appl. No.: 08/869,570

[22] Filed: Jun. 5, 1997

[30] Foreign Application Priority Data

Jun. 7, 1996 [DE] Germany ..... 196 22 740

[51] Int. Cl.[7] ..... B22D 11/126

[52] U.S. Cl. ..... 29/527.7; 29/33 C; 72/201; 72/203

[58] Field of Search ..... 29/527.7, 33 C; 72/201, 203; 164/476, 477

[56] References Cited

U.S. PATENT DOCUMENTS 5,156,033 10/1992 Matsuo et al. ..... 72/203
5,423,200 6/1995 Shore ..... 72/203
5,467,519 11/1995 Tippins et al. ..... 29/33 C

*Primary Examiner*—P. W. Echols
*Attorney, Agent, or Firm*—Friedrich Kueffner

[57] ABSTRACT

A method of operating a roll stand arrangement including one or more edging/roughing stands followed by a compact rolling group arranged transversely offset relative to the edging/roughing stands and connected to the edging/roughing stands through connecting roller conveyors and a transverse conveying unit. The compact rolling group is composed of first and second universal stands or two-high stands and an intermediate edging stand arranged between the first and second stands. In accordance with a predetermined cycle, preliminary sections arriving from a continuous casting plant are supplied directly without intermediate storage to the roll stand arrangement and are finish rolled successively in the compact rolling group into profiled rolled strands and are supplied, before or while the next following preliminary section enters the compact rolling group, to a cooling bed arranged laterally of the rolling line. When rolling sections whose finish rolling time is longer than the cycle predetermined by the continuous casting plant, a first length portion of the rolled strand which has already emerged from the compact rolling group is severed from the rolled strand and is supplied to the cooling bed.

2 Claims, 1 Drawing Sheet

METHOD OF OPERATING A ROLL STAND ARRANGEMENT

BACKGROUND OF THE INVENTION

1. Field of the Invention

The present invention relates to a method of operating a roll stand arrangement including one or more edging/roughing stands followed by a compact rolling group arranged transversely offset relative to the edging/roughing stands and connected to the edging/roughing stands through connecting roller conveyors and a transverse conveying unit. The compact rolling group is composed of first and second universal stands or two-high stands and an intermediate edging stand arranged between the first and second stands. In accordance with a predetermined cycle, preliminary sections arriving from a continuous casting plant are supplied directly without intermediate storage to the roll stand arrangement and are finish rolled successively in the compact rolling group into profiled rolled strands and are supplied, before or while the next following preliminary section enters the compact rolling group, to a cooling bed arranged laterally of the rolling line.

2. Description of the Related Art

In the known method described above, the cooling bed arranged following the compact rolling group has a conveying width which corresponds to the length of the finish rolled strand. This arrangement makes it possible to continuously operate the roll stand arrangement in accordance with the cycle of the continuous casting plant if the output of the roll stand arrangement with respect to shaping the preliminary section into the finish rolled strand requires the same or a shorter period of time as is required by the continuous casting plant for producing a preliminary section.

As the cross-section and the weight per unit of length of the finish rolled strand are being reduced, the output per unit of time of the roll stand arrangement becomes smaller and, when a certain section size is reached, the output of the roll stand arrangement is no longer sufficient for processing the production of the continuous casting plant within the given cycle; it is then necessary to carry out a complicated intermediate storage of the preliminary sections produced by the continuous casting plant.

SUMMARY OF THE INVENTION

Therefore, it is the primary object of the present invention to improve the method of operating a roll stand arrangement described above in such a way that it is also possible to carry out the shaping of smaller sections within the cycle of the continuous casting plant.

In accordance with the present invention, when rolling sections whose finish rolling time is longer than the cycle predetermined by the continuous casting plant, a first length portion of the rolled strand which has already emerged from the compact rolling group is severed from the rolled strand and is supplied to the cooling bed.

In accordance with another advantageous feature of the present invention, the first length portion severed from the rolled strand has a length which is half of the total length of the finish rolled strand. Cutting of the first length portion can be carried out in the rolling line in front of the cooling bed and the severed first length portion can be moved out of the rolling line onto the cooling bed.

In accordance with another possibility, the first length portion is cut in the rolling line behind the cooling bed, wherein initially the second length portion is moved onto the cooling bed and subsequently the first length portion is conveyed back in the rolling line in front of the cooling bed and is then moved onto the cooling bed.

The method according to the present invention can be carried out in such a way that it utilizes the intermission period which lasts until the respectively next preliminary section is introduced into the compact rolling group as well as the two first reversing passes which are still relatively short.

The rolled strand can be cut while it rests without moving on the roller conveyor, so that a simple cutting device, such as a saw or flame cutting device, can be used instead of flying saws or shears.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE PREFERRED EMBODIMENTS

Figure 1:
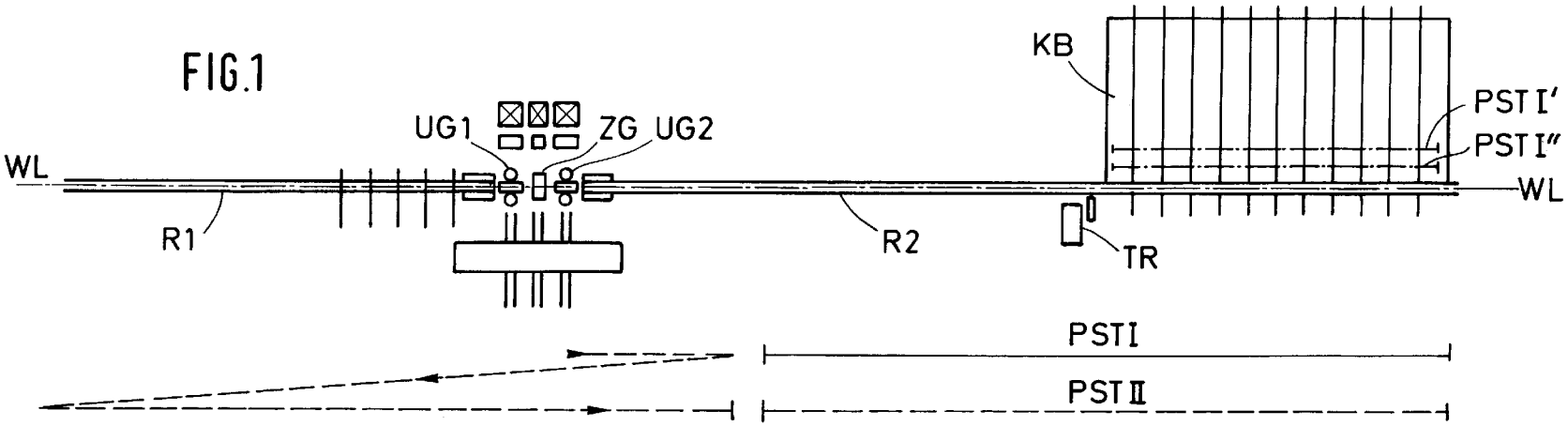
FIG. 1 is a schematic top view of a roll stand arrangement used for carrying out the method according to the present invention.

In the embodiment illustrated in FIG. 1, the roll stand arrangement is composed of a feed roller conveyor or table R1, a compact rolling group composed of the universal stands UG1 and UG2 and an intermediate stand arranged between the universal stands, a run-out roller conveyor or table R2 arranged following the compact rolling group and a cooling bed KB arranged laterally of the run-out roller conveyor R2 and laterally of the rolling line WL, as well as cutting device TR arranged in front of the cooling bed KB.

The roll stand arrangement is operated as follows: The first finish rolled strand PSTI emerging from the compact rolling group is moved on the run-out roller conveyor R2 in front of the cooling bed and is stopped. Subsequently, by means of the cutting device TR, the first length portion PSTI' located in front of the cooling bed KB is cut and is moved onto the cooling bed. Subsequently, the second length portion PSTI" which still is on the run-out roller conveyor R2 is moved in front of the cooling KB and is then also moved onto the cooling bed KB. In the interim, the next following rolled strand PSTII, shown in broken lines, which is produced from the next preliminary section, not shown, by initially short reversing passes, is moved onto the run-out roller conveyor R2 and, after having been finish rolled, is cut and the resulting length portions are placed onto the cooling bed as described above.

Figure 2:
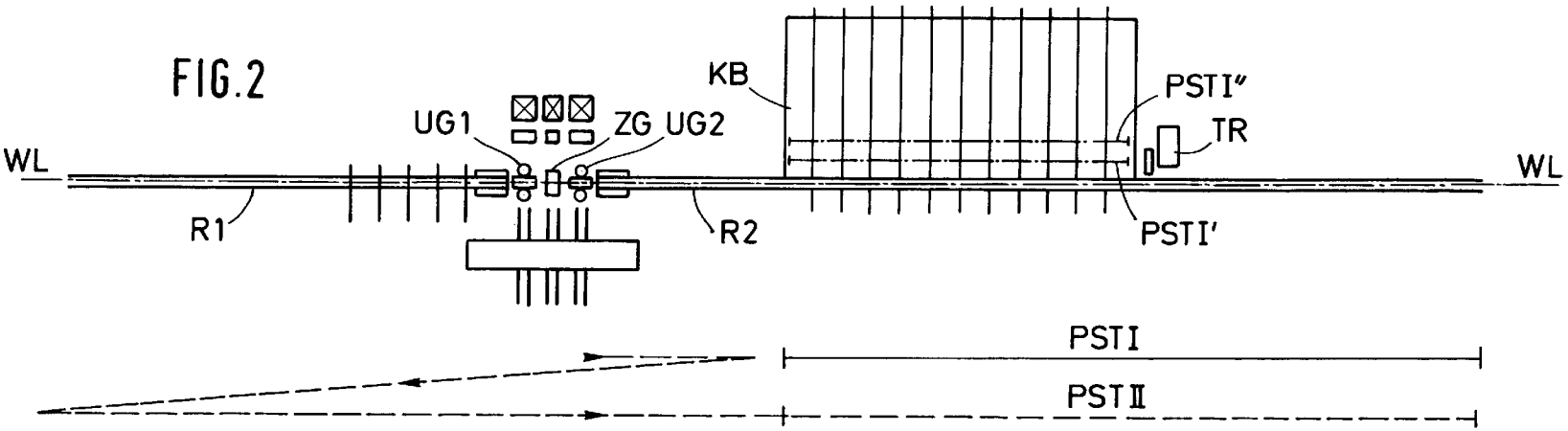
FIG. 2 is a schematic top view of another embodiment of the roll stand arrangement.

The embodiment of the roll stand arrangement of FIG. 2 corresponds essentially to that of FIG. 1 with the difference that the cooling bed KB in FIG. 2 is arranged closer to the compact rolling group by a distance which corresponds approximately to the length of a length portion of the divided rolled strand. In addition, as seen in the direction of the rolling line WL, the cutting device TR is arranged following the cooling bed KB. In this case, the rolled strand PSTI emerging from the compact rolling group and placed on the run-out roller conveyor R2 is cut by means of the cutting device TR while being placed on the run-out roller conveyor R2 in front of the cooling bed KB and subsequently, contrary to the embodiment of FIG. 1, initially the rear length portion PSTI", as seen in conveying direction, is moved onto the cooling bed KB. Subsequently, the second length portion PSTI' is moved back on the roller conveyor R2 against the rolling direction until it is located in front of the cooling bed KB and is then pushed onto the cooling bed KB. The next following rolled strand PSTII is then handled in the same manner as described in connection with FIG. 1; however, also in this case, initially the rear length portion PSTI" is moved onto the cooling bed KB and then the front length portion PSTI, after first having been moved back against the conveying direction, is moved onto the cooling bed KB.

The invention is not limited by the embodiments described above which are presented as examples only but can be modified in various ways within the scope of protection defined by the appended patent claims.

We claim:

1. A method of rolling sections in a roll stand arrangement composed of first and second universal stands or two-high stands and an intermediate edging stand arranged between the first and second stands, wherein a run-out roller conveyor is arranged following the roll stand arrangement and a cooling bed is arranged laterally of the run-out table, the method comprising supplying preliminary sections from a continuous casting plant in accordance with a cycle predetermined by an output of the continuous casting plant to the roll stand arrangement, finish rolling the sections in the roll stand arrangements in a number of passes and reversing passes, supplying each rolled section to the run-out roller conveyor, severing the rolled section in a middle thereof into a front length portion and a rear length portion in a conveying direction, further comprising moving the front length portion onto the cooling bed, moving the rear length portion on the run-out roller conveyor next to the cooling bed and subsequently moving the rear length portion onto the cooling bed, wherein during moving the rear length portion a next preliminary section supplied by the continuous casting plant is introduced into and rolled in the roll stand arrangement.

2. A method of rolling sections in a roll stand arrangement composed of first and second universal stands or two-high stands and an intermediate edging stand arranged between the first and second stands, wherein a run-out roller conveyor is arranged following the roll stand arrangement and a cooling bed is arranged laterally of the run-out table, the method comprising supplying preliminary sections from a continuous casting plant in accordance with a cycle predetermined by an output of the continuous casting plant to the roll stand arrangement, finish rolling the sections in the roll stand arrangements in a number of passes and reversing passes, supplying each rolled section to the run-out roller conveyor, severing the rolled section in a middle thereof into a front length portion and a rear length portion in a conveying direction, further comprising moving the rear length portion onto the cooling bed, moving the front length portion on the run-out roller conveyor next to the cooling bed and subsequently moving the front length portion onto the cooling bed, wherein during moving the front length portion a next preliminary section supplied by the continuous casting plant is introduced into and rolled in the roll stand arrangement.

* * * * *